US010676689B2

(12) United States Patent
Agrawal et al.

(10) Patent No.: US 10,676,689 B2
(45) Date of Patent: Jun. 9, 2020

(54) GREASE COMPOSITIONS FOR LOW TEMPERATURE OPERATION

(71) Applicant: ExxonMobil Research and Engineering Company, Annandale, NJ (US)

(72) Inventors: Sarvesh K. Agrawal, Spring, TX (US); James E. Spagnoli, Leland, NC (US); David A. Blain, Cherry Hill, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 16/215,916

(22) Filed: Dec. 11, 2018

(65) Prior Publication Data

US 2019/0203150 A1 Jul. 4, 2019

Related U.S. Application Data

(60) Provisional application No. 62/611,581, filed on Dec. 29, 2017.

(51) Int. Cl.

| | |
|---|---|
| ***C10M 169/04*** | (2006.01) |
| ***C10M 111/02*** | (2006.01) |
| ***C10M 169/02*** | (2006.01) |
| ***C10M 171/02*** | (2006.01) |
| ***C10M 101/02*** | (2006.01) |
| ***C10M 145/14*** | (2006.01) |

(52) U.S. Cl.

CPC ..... *C10M 169/04* (2013.01); *C10M 101/02* (2013.01); *C10M 111/02* (2013.01); *C10M 145/14* (2013.01); *C10M 169/02* (2013.01); *C10M 171/02* (2013.01); *C10M 2203/045* (2013.01); *C10M 2203/1045* (2013.01); *C10M 2203/1065* (2013.01); *C10M 2203/1085* (2013.01); *C10N 2220/022* (2013.01); *C10N 2220/026* (2013.01); *C10N 2230/02* (2013.01); *C10N 2230/43* (2013.01); *C10N 2250/10* (2013.01)

(58) Field of Classification Search

CPC ..... C10N 2250/10; C10N 2220/022; C10N 2230/02; C10M 2203/1045; C10M 2203/1065

See application file for complete search history.

(56) References Cited

U.S. PATENT DOCUMENTS

| | | | |
|---|---|---|---|
| 2,751,351 A | 6/1956 | Young et al. | |
| 3,712,864 A | 1/1973 | Loeffler et al. | |
| 4,064,058 A | 12/1977 | Walker | |
| 4,582,616 A | 4/1986 | Kita et al. | |
| 6,541,427 B1 | 4/2003 | Dresel | |
| 7,641,786 B2 | 1/2010 | Wang et al. | |
| 7,642,095 B2 | 1/2010 | Wang et al. | |
| 7,704,930 B2 | 4/2010 | Deckman et al. | |
| 2006/0223720 A1 | 10/2006 | Sullivan et al. | |
| 2007/0289897 A1 | 12/2007 | Carey et al. | |
| 2008/0020958 A1 | 1/2008 | Poirier et al. | |
| 2009/0088353 A1 | 4/2009 | Berry et al. | |
| 2009/0088354 A1 | 4/2009 | Berry et al. | |
| 2009/0208157 A1 | 8/2009 | Egami | |
| 2009/0247441 A1 | 10/2009 | Baum | |
| 2013/0217606 A1* | 8/2013 | Wang | C10M 129/60 508/449 |
| 2013/0267450 A1* | 10/2013 | Patil | C10M 105/34 508/459 |

FOREIGN PATENT DOCUMENTS

| | | |
|---|---|---|
| CN | 101157878 A | 4/2008 |
| CN | 101880581 A | 11/2010 |
| CN | 101880582 A | 11/2010 |
| CN | 101886018 A | 11/2010 |
| CN | 102816630 A | 12/2012 |
| CN | 103897781 A | 7/2014 |
| CN | 104194893 A | 8/2015 |
| CN | 104830499 A | 8/2015 |
| CN | 105132102 A | 12/2015 |
| DE | 2027403 A1 | 12/1971 |
| GB | 1341738 A | 12/1973 |
| JP | 60044596 A | 3/1985 |
| JP | 2028295 A | 1/1990 |
| JP | 2007056139 A | 3/2007 |

OTHER PUBLICATIONS

The International Search Report and Written Opinion of PCT/US2018/064858 dated Mar. 7, 2019.

Anderson et al., "Composition and analysis of mineral oils and other organic compounds in metalworking and hydraulic fluids", Critical Reviews in Environmental Science and Technology, CRC Press, vol. 33, No. 1, (2003), pp. 73-109.

Pfestorf, "31 Cyclische Verbindungen", Chemie—Ein Lehrbuch fur Fachhochschulen, Verlag Europa-Lehrmittel, Haan-Gruiten, (2013), p. 503.

* cited by examiner

*Primary Examiner* — Vishal V Vasisth

(74) *Attorney, Agent, or Firm* — Robert A. Migliorini

(57) ABSTRACT

Grease compositions are provided that can have one or more unexpectedly beneficial low temperature properties even though the grease compositions are formed from lower value components that traditional low temperature greases. The unexpectedly beneficial low temperature properties can be achieved in part by grease compositions that include a naphthenic base stock having a viscosity index of roughly 120 or less and/or a pour point of −20° C. or more while having a naphthenes content of 60 wt % or more. In some aspects, the naphthenic base stock can have an aromatics content of 20 wt % or less.

22 Claims, No Drawings

GREASE COMPOSITIONS FOR LOW TEMPERATURE OPERATION

CROSS-REFERENCE TO RELATED APPLICATIONS

This application claims the benefit of U.S. Provisional Application No. 62/611,581, filed on Dec. 29, 2017, the entire contents of which are incorporated herein by reference.

FIELD

This disclosure relates to grease compositions with beneficial properties in low temperature environments.

BACKGROUND

Lubricant greases are typically formulated to include a combination of lubricant base stocks with additives to provide additional desired properties. Conventionally, the combination of lubricant base stocks can include a portion of bright stock and a portion of a light neutral or heavy neutral base stock. The additives can typically include a thickening agent.

Formulating lubricant greases for cold temperature environments can present additional difficulties. Greases used in equipment in cold environments can offer increased resistance to motion of moving parts, which can lead to corresponding increases in power required to move such parts and/or increases in wear on the equipment. Additionally, during equipment startup in a cold environment, a grease may have increased resistance to movement based on the yield-stress properties of the grease. In addition to causing increased power consumption, the increased resistance to movement may lead to equipment failure due to failure to properly lubricate intended surfaces in the equipment. Reduced grease mobility can also lead to difficulties in pumping grease from a central reservoir within an equipment environment.

In order to overcome the above difficulties, greases for use in low temperature environments are typically formulated using a combination of brightstock and a base stock selected from Group III base stocks, Group IV base stocks, or Group V base stocks. While these types of base stocks can be effective for making low temperature greases, such base stocks can substantially increase the cost of the resulting grease. Thus, it would be desirable to develop grease formulations suitable for low temperature use that can be made using lower cost components.

U.S. Patent Application Publication 2008/0020958 describes grease compositions that are formulated using lubricants based on Fischer-Tropsch waxes and/or polyalphaolefin lubricants. The resulting lubricants can have desirable low temperature properties while also having low evaporation loss at high temperatures.

SUMMARY

In various aspects, grease compositions are provided that can have one or more unexpectedly beneficial low temperature properties even though the grease compositions are formed from lower value components that traditional low temperature greases. The unexpectedly beneficial low temperature properties can be achieved in part by grease compositions that include a naphthenic base stock having a viscosity index of roughly 120 or less and/or a pour point of −20° C. or more while having a naphthenes content of 60 wt % or more. In some aspects, the naphthenic base stock can have an aromatics content of 20 wt % or less. Additionally or alternately, the naphthenic base stock can have a paraffin content of 20 wt % or less. In some aspects, the naphthenic base stock can have a viscosity index of 118 or less. In some aspects, the naphthenic base stock can have a pour point of −20° C. or more. In some aspects, the naphthenic base stock can have a kinematic viscosity at 100° C. of 15 cSt or less.

DETAILED DESCRIPTION

All numerical values within the detailed description and the claims herein are modified by "about" or "approximately" the indicated value, and take into account experimental error and variations that would be known to a person of ordinary skill in the art. The phrase "major amount" or "major component" as it relates to components included within the lubricating oils of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the lubricating oil. The phrase "minor amount" or "minor component" as it relates to components included within the lubricating oils of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the lubricating oil. The phrase "essentially free" as it relates to components included within the lubricating oils of the specification and the claims means that the particular component is at 0 weight % within the lubricating oil, or alternatively is at impurity type levels within the lubricating oil (less than 100 ppm, or less than 20 ppm, or less than 10 ppm, or less than 1 ppm). The phrase "other grease performance additives" as used in the specification and the claims means other lubricating oil additives that are not specifically recited in the particular section of the specification or the claims. For example, other grease performance additives may include, but are not limited to, antioxidants or oxidation inhibitors, anticorrosive agents or corrosion inhibitors, extreme pressure additives, antiwear agents, pour point depressants, rust inhibitors, metal deactivators, dispersants, demulsifiers, dyes or colorant/chromophoric agents, seal compatibility agents, friction modifiers, viscosity modifier/improvers, viscosity index improvers and combinations thereof.

The viscosity-temperature relationship of a lubricating oil is one of the criteria which can be considered when selecting a lubricant for a particular application. Viscosity Index (VI) is an empirical, unitless number which indicates the rate of change in the viscosity of an oil within a given temperature range. VI is determined according to ASTM method D 2270-93 [1998]. VI is related to kinematic viscosities measured at 40° C. and 100° C. using ASTM Method D 445-01.

As used herein, the term "major component" means a component (e.g., base stock) present in a lubricating oil of this disclosure in an amount greater than about 50 weight percent.

As used herein, the term "minor component" means a component (e.g., one or more lubricating oil additives) present in a lubricating oil of this disclosure in an amount less than about 50 weight percent.

In this discussion, hydrocarbons or other compounds within a composition may be referred to as aromatics, naphthenes, or paraffins. An aromatic is defined as a hydrocarbon-like compound including at least one aromatic ring. A naphthene is defined as a hydrocarbon-like compound that includes at least one ring that is at least partially unsaturated without including an aromatic ring. Thus, a naphthenoaromatic compound is referred to as an aromatic compound in this discussion. A paraffin is defined as a hydrocarbon-like compound that does not include a ring structure. Thus, compounds containing aromatic or naphthenic rings are referred to based on the aromatic or naphthenic ring content, even though the compound may also include aliphatic hydrocarbon chains.

In this discussion, a naphthenic lubricant base stock is defined as a lubricant base stock having a naphthene content of 55 wt % or more, or 60 wt % or more, or 65 wt % or more, or 70 wt % or more, such as up to 85 wt % or possibly still higher.

Overview

In various aspects, grease compositions are provided that can have one or more unexpectedly beneficial low temperature properties even though the grease compositions are formed from lower value components that traditional low temperature greases. The unexpectedly beneficial low temperature properties can be achieved in part by grease compositions that include a naphthenic base stock having a viscosity index of roughly 120 or less and/or a pour point of −20° C. or more while having a naphthenes content of 60 wt % or more, or 65 wt % or more, or 70 wt % or more, such as up to 85 wt % or possibly still higher. In some aspects, the naphthenic base stock can have an aromatics content of 20 wt % or less, or 15 wt % or less, or 10 wt % or less, such as down to 0.1 wt % or possibly still lower. Additionally or alternately, the naphthenic base stock can have a paraffin content of 20 wt % or less, or 15 wt % or less, or 10 wt % or less, such as down to 0.1 wt % or possibly still lower. In various aspects, the naphthenic base stock can have a viscosity index of 120 or less, or 118 or less, or 115 or less, or 110 or less, or 100 or less, such as down to about 85 or possibly still lower. In various aspects, the naphthenic base stock can have a pour point of −20° C. or more, or −15° C. or more, or −10° C. or more, such as up to 10° C. or possibly still higher. In various aspects, the naphthenic base stock can have a kinematic viscosity at 100° C. of 15 cSt or less, or 12 cSt or less, such as down to 4 cSt or possibly still lower.

In addition to the naphthenic base stock, the grease composition can also include various traditional components of a grease composition. For example, another major component in the grease composition can be a brightstock or other lubricant base stock with a higher kinematic viscosity at 100° C. The grease composition can include 20 wt % or more, or 30 wt % or more, or 40 wt % or more of a brightstock, such as up to 55 wt % or possibly still higher. In various aspects, the brightstock can have a viscosity index of 80 to 120, or 80 to 105, or 90 to 120. Additionally or alternately, the brightstock can have a pour point of 10° C. to −10° C. Additionally or alternately, the brightstock can have a kinematic viscosity at 100° C. of 16 cSt or more, or 24 cSt or more, or 30 cSt or more, such as up to 50 cSt or possibly still higher.

The grease composition can also include one or more additives. For example, the grease composition can include a viscosity modifier additive to achieve a typical or desired consistency for the grease. Additionally or alternately, various additives and/or additive types typically found in a grease composition can be included in the one or more additives.

In some aspects, a benefit of using a naphthenic lubricant base stock to form a grease composition can be an improved ability to maintain solubility of additives in the grease. Many types of traditional lubricants for low temperature grease compositions can correspond to substantially paraffinic lubricants, such as lubricants based on Fischer-Tropsch products or polyalphaolefins. Such paraffinic lubricants can have a relatively low solubility for additives with, for example, a highly aromatic character. This can pose difficulties when attempting to form a grease having desired properties, as limitations on the ability to add lower cost additives may require still larger amounts of the potentially higher cost paraffinic lubricants to achieve desired properties.

Properties of Grease Composition Based on Naphthenic, Low Viscosity Index Base Stock Conventionally, the low temperature properties of a grease composition are expected to be related to the pour point of the base stocks used in the grease composition. However, it has been discovered that the torque and/or flow properties of a grease composition made using a naphthenic base stock can be unexpectedly beneficial.

In various aspects, a grease composition including 40 wt % or more of a naphthenic base stock (such as a base stock that includes 60 wt % or more of naphthenes) and a viscosity index of 120 or less can provide one or more advantages with respect to low temperature properties. Such advantages can include, but are not limited to, a reduced or minimized starting torque and/or torque at 60 seconds under a test according to ASTM D4693 at a test temperature of −40° C.; and a reduced or minimized flow pressure under a test according to DIN 51805 MOD at a test temperature of −20° C.

The above beneficial properties can be achieved by a grease composition that otherwise has characteristics that would be expected based on the pour point of the naphthenic base stock. For example, the drop point and penetration values for the grease composition can be comparable to the drop point and penetration values for other grease compositions having similar formulations but that include a base stock that contains less than 60 wt % of naphthenes.

Grease Additives

A formulated grease composition, lubricating oil, and/or other lubricant useful in the present disclosure may contain one or more of the other commonly used grease performance additives including but not limited to antiwear additives, detergents, dispersants, viscosity modifiers, corrosion inhibitors, rust inhibitors, metal deactivators, extreme pressure additives, anti-seizure agents, wax modifiers, other viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see "Lubricant Additives, Chemistry and Applications", Ed. L. R. Rudnick, Marcel Dekker, Inc. 270 Madison Ave. New York, N.J. 10016, 2003, and Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil that may range from 5 weight percent to 50 weight percent.

The additives useful in this disclosure do not have to be soluble in the grease composition and/or the base stocks.

Insoluble additives such as zinc stearate in oil can be dispersed in the grease composition and/or base stocks of this disclosure.

When grease compositions and/or base stocks contain one or more additives, the additive(s) are blended into the composition in an amount sufficient for it to perform its intended function. Additives are typically present in lubricating oil compositions as a minor component, typically in an amount of less than 50 weight percent, preferably less than about 30 weight percent, and more preferably less than about 15 weight percent, based on the total weight of the composition. Additives are most often added to grease compositions and/or base stocks in an amount of at least 0.1 weight percent, preferably at least 1 weight percent, more preferably at least 5 weight percent. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the Table 1 below, as well as other amounts mentioned herein, are directed to the amount of active ingredient (that is the non-diluent portion of the ingredient). The weight percent (wt %) indicated below is based on the total weight of the grease composition.

TABLE 1

Typical Amounts of Other Grease Composition Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of grease/lubricant oil additives. Additive packages with a variety of ingredients, proportions and characteristics are available and selection of the appropriate package will take the requisite use of the ultimate composition into account.

The grease compositions of the present disclosure are well suited as grease compositions without blending limitations, and further, the lube base stock products are also compatible with lubricant additives for lubricant formulations. The lube base stocks and/or grease compositions described herein can optionally be blended with other lube base stocks and or greases to form lubricants. Useful cobase lube stocks include Group I, III, IV and V base stocks and gas-to-liquid (GTL) oils. One or more of the cobase stocks may be blended into a lubricant composition including the lube base stock at from 0.1 to 50 wt. %, or 0.5 to 40 wt. %, 1 to 35 wt. %, or 2 to 30 wt. %, or 5 to 25 wt. %, or 10 to 20 wt. %, based on the total lubricant composition.

The lube base stocks and grease composition can be employed in the present disclosure in a variety of lubricant-related end uses, such as a lubricant oil or grease for a device or apparatus requiring lubrication of moving and/or interacting mechanical parts, components, or surfaces. Useful apparatuses include engines and machines. The grease compositions of the present disclosure are most suitable for use in the formulation of automotive crank case lubricants, automotive gear oils, transmission oils, many industrial lubricants including circulation lubricant, industrial gear lubricants, grease, compressor oil, pump oils, refrigeration lubricants, hydraulic lubricants, metal working fluids.

The following non-limiting examples are provided to illustrate the disclosure.

Example 1—Base Stocks for Formulation of Grease Compositions

Three base stocks having comparable pour points and kinematic viscosities but different naphthene contents were used to make grease compositions. The formulations for the grease compositions were the same with the exception of including one of the three base stocks in the composition. Table 1 provides additional details for each of the three base stocks.

In Table 2, the paraffin, 1-ring naphthene, 2-ring naphthene, and aromatics contents were determined based on 2-dimensional gas chromatography (2D-GC). The methodology for the 2D-GC measurements is described in detail in U.S. Pat. Nos. 7,642,095 and 7,641,786, which are incorporated herein by reference for the limited purpose of describing how to determine a composition of a lubricant bases stock.

TABLE 2

Base Stock Properties

| | Base Stock A | Base Stock B | Base Stock C |
|---|---|---|---|
| Paraffins (wt %) | 25.0 | 26.0 | 16.5 |
| 1R-Naphthenes (wt %) | 33.3 | 30.4 | 39.7 |
| 2R-Naphthenes (wt %) | 21.5 | 20.0 | 29.3 |
| Aromatics (wt %) | 20.2 | 23.6 | 14.5 |
| Total (wt %) | 100 | 100 | 100 |
| Pour Point (° C.) D97 | −15 | −12 | −12 |
| KV@40° C. (cSt) D445 | 110.7 | 110.9 | 111.98 |
| Total Aromatics - High Sats | 680.4 | 627.1 | 4.5 |
| 1R Aromatics - High Sats | 232.2 | 250.1 | 3.8 |
| 2R Aromatics - High Sats | 74.7 | 101.1 | 0.5 |
| 3R Aromatics - High Sats | 91.9 | 81.1 | 0 |
| 4 + R Aromatics - High Sats | 0.4 | 0.4 | 0.1 |
| UV Absorptivities | | | |
| @226 nm | 9.1 | 9.68 | 0.05 |
| @254 nm | 3.063 | 3.57 | 0.002 |
| @275 nm | 2.34 | 2.73 | 0.004 |
| @302 nm | 0.8637 | 1.1183 | 0.0011 |
| @310 nm | 0.5917 | 0.7394 | 0.0009 |
| @325 nm | 0.3351 | 0.3787 | 0.0003 |
| @339 nm | 0.162 | 0.1933 | 0.0002 |
| @400 nm | 0.00217 | 0.00547 | 0.00003 |

As shown in Table 2, Base Stocks A, B, and C have similar pour points and similar kinematic viscosities at 100° C. Conventionally, it would be expected that grease compositions formulated using Base Stocks A, B, and C would have similar low temperature properties. However, Base Stock C has a higher naphthene content, lower paraffin content, and lower aromatics content than Base Stock A or Base Stock B. It has been unexpectedly discovered that this compositional difference can allow naphthenic base stocks similar to Base Stock C (i.e., increased naphthene content with decreased aromatic content and/or decreased paraffin content) to be used in production of grease compositions have unexpectedly beneficial low temperature properties.

Base Stocks A, B, and C from Table 2 were used to formulate grease compositions corresponding to Grease A, Grease B, and Grease C based on the formulation shown in Table 3.

TABLE 3

| Grease Formulation | | |
|---|---|---|
| Component | Units | Amount |
| <Base Stock A, B, or C> | Wt % | 40.49 |
| Bright Stock | Wt % | 40.50 |
| methyl 12-hydroxy stearates | Wt % | 7.50 |
| Lithium hydroxide, monohydrate | Wt % | 1.06 |
| Viscosity modifier | Wt % | 4.40 |
| Mixed alkyl borate ester | Wt % | 1.20 |
| Anti-wear additive | Wt % | 1.50 |
| Aminic Antioxidant | Wt % | 1.00 |
| <Additional Performance Additive> | Wt % | 1.00 |
| Zinc naphthenate | Wt % | 0.75 |
| Corrosion inhibitor | Wt % | 0.10 |
| Polymer-based Viscosity Modifier | Wt % | 0.50 |

The brightstock referenced in Table 3 had a viscosity index of 95, a pour point of −6° C., a kinematic viscosity at 100° C. of 30-33 cSt, a flash point of 294° C., and an ASTM Color of 6.0 (D1500).

Example 2—Grease Properties

Grease A, Grease B, and Grease C were tested to determine low temperature torque (ASTM D4693), flow pressure (Minitest FFK, DIN 51805 MOD), drop point (ASTM D2265), and full scale penetration (ASTM D217). Table 4 shows the results from performing the tests on each of Grease A, Grease B, and Grease C. It is noted that in Table 4, certain tests were repeated for Grease C.

TABLE 4

| | Grease Properties | | | |
|---|---|---|---|---|
| Low Temperature Torque | Grease A | Grease B | Grease C | Grease C—Repeat |
| Starting Torque (N-m) | 21.8 | 20.0 | 17.5 | |
| Torque at 60 seconds (N-m) | 12.6 | 15.2 | 10.8 | |
| Test Temperature (° C.) | −40 | −40 | −40 | |
| Minitest FFK—Flow Pressure (kPa-a) | 107.5 | 107.5 | 80.0 | 72.5 |
| Test Temperature (° C.) | −20 | −20 | −20 | −20 |
| Drop Point (° C.) | 261 | 284 | 265 | 254 |
| Full scale penetration (dmm), worked | 265 | 299 | 288 | 290 |
| Full scale penetration (dmm), unworked | 261 | 290 | 282 | 292 |

As shown in Table 4, Grease A and Grease B have similar or comparable values for each of the investigated properties. Grease C, however, provides unexpectedly improved low temperature property values while having comparable values for other properties.

For low temperature torque, Grease C has both a lower starting torque value of 17.5 N-m and a lower torque @ 60 seconds value of 10.8 N-m. This indicates that Grease C unexpectedly provides both less static resistance and dynamic resistance at the test temperature of −40° C. It is noted that the relative pour points of Base Stocks A, B, and C would suggest comparable low temperature torque values for each of Grease A, Grease B, and Grease C, with Grease A possibly have better values. In particular, the pour point of Base Stock C is −12° C., which is the same as Base Stock B and actually higher than the pour point of Base Stock A (−15° C.). For Grease A and Grease B, the starting torque values are comparable, as would be expected. While Grease A provides a lower torque at 60 seconds than Grease B, as might be expected based on the lower pour point for Base Stock A, the torque at 60 seconds value for Grease A is still substantially higher than the torque at 60 seconds for Grease C.

Grease C also provides unexpectedly lower values for flow pressure. The DIN 51805 MOD test procedure provides a pressure corresponding to the minimum pressure for causing a grease at rest in a small tube to become mobile. As shown in Table 4, the minimum flow pressure at −20° C. for Grease C is 80 kPa-a or less, with a repeat test providing a still lower value. This is in contrast to Grease A and Grease B, which both had a minimum flow pressure at −20° C. of more than 100 kPa-a. Again, the flow test pressures for Grease A, Grease B, and Grease C would all be expected conventionally to be similar, with Grease A possibly having the lowest value. Instead, the increased naphthenic content of Base Stock C in Grease C provides an unexpectedly lower minimum flow pressure under the test procedure in DIN 51805 MOD.

Table 4 also provides values for drop point and penetration. The drop point and penetration values for Grease A, Grease B, and Grease C demonstrate that the three grease compositions are comparable in other measures of performance. The drop point of 265° C. for Grease C is similar to Grease A and slightly lower than Grease B. With regard to penetration, the penetration values for Grease C (both worked and unworked) are between the penetration values for Grease A and Grease B.

Additional Description of Lubricating Oils and Grease Additives

A wide range of lubricating base oils is known in the art. Lubricating base oils that are useful in the present disclosure are natural oils, mineral oils and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. Table 5 below summarizes properties of each of these five groups.

TABLE 5

Properties of Base Oil Groups

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | | polyalphaolefins (PAO) | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks are also well known base stock oils.

A grease composition will typically contain small amounts of additives such as anticorrosive agents, extreme pressure and antiwear agents, pour point depressants, tackiness agents, oxidation inhibitors, dyes, and the like. The amounts of individual additives will vary according to the additive and the level of functionality to be provided by it. The total amount of these additives will typically range from about 2 to about 5 wt % based on total weight of the grease composition. In addition, solid lubricants such as molybdenum disulfide and graphite may be present in the composition, typically from about 1 to about 5 wt % (preferably from about 1.5 to about 3 wt %) for molybdenum disulfide and from about 3 to about 15 wt % (preferably from about 6 to about 12 wt %) for graphite.

When the additives are described below by reference to individual components used in the formulation, they will not necessarily be present or identifiable as discrete entities in the final product but may be present as reaction products which are formed during the grease manufacture or even its use. This will depend on the respective chemistries of the ingredients, their stoichiometry, and the temperatures encountered in the greasemaking process or during its use. It will also depend, naturally enough, on whether or not the species are added as a pre-reacted additive package. For example, the acid amine phosphates may be added as discrete amines and acid phosphates but these may react to form a new entity in the final grease composition under the processing conditions used in the grease manufacture.

At least one antioxidant will be present to retard oxidative degradation of the grease while in storage and use. Typically, these additives will be either aminic antioxidants or phenolic antioxidants; antioxidants of these two classes may be used together. Aminic antioxidants are generally aromatic amines of which the naphthylamines are in common use, e.g. alpha.-naphthylamine, phenyl-alpha.-naphthylamine, butylphenyl-.alpha.-naphthylamine, pentylphenyl-.alpha.-naphthylamine, hexylphenyl-.alpha.-naphthylamine, heptylphenyl-.alpha.-naphthylamine, octylphenyl-.alpha.-naphthylamine and nonylphenyl-.alpha.-naphthylamine; the monoalkylphenyl alpha-naphthylamines e.g. tert.-octyl-phenyl-α-naphtylamine and monononyldiphenylamine are particular common. Other classes of aromatic amines include the dinuclear aromatic amines such as the dialkyl-diphenylamines, e.g. 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine. Amities of both types may be used singly or in combination with one another. The combination of tert.-octyl-phenyl-α-naphtylamine and dioctyl-diphenylamine is common Amine antioxidants are generally used in amounts from about 0.01 to 5 wt %, more usually from 0.5 to 1.5 wt %. Phenolic antioxidants, typically used in amounts from about 0.01 to 5 wt %, more usually from 0.5 to 1.5 wt %., are typified by the alkylated hydroxytoluenes, e.g. butylated hydroxytoluene.

Other types of antioxidant may also be considered, including the sulfur-containing antioxidants, for example, dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide.

Given the necessity of securing good corrosion resistance, the grease will include a corrosion inhibitor of a type which is effective for rust inhibition; non-ferrous metal, especially copper, passivation functionality may also be useful. Corrosion inhibitors are a well-established class of additives and may typically be physical inhibitors which form a barrier type film on the metal or chemical type inhibitors which react on the metal surface to form a protective coating. Physical type inhibitors include the metal naphthenates and petroleum sulfonates, e.g barium petroleum sulfonates, zinc naphthenate and the like with preference for the zinc and calcium salts for their improved environmental acceptability.

The metal sulfonates and naphthenates are effective and suitable for use in many applications as corrosion inhibitor.

The more aggressive chemical type inhibitors including the amine phosphates and imidazolines, are known to confer good corrosion (rust) inhibition in conventional grease compositions.

The amine rust inhibitors will generally contain from 8 to 24 carbon atoms and can be primary, secondary, tertiary, acyclic or cyclic, mono or polyamines. They can also be heterocyclic. The amine containing components can also contain other substituents, e.g, ether linkages or hydroxyl moieties. The preferred amines are generally aliphatic in nature. Some specific examples include: octylamine, decylamine, $C_{10}$, $C_{12}$, $C_{14}$ and $C_{16}$ tertiary alkyl primary amines (or combinations thereof), laurylamine, hexadecylamine, heptadecylamine, octadecylamine, decenylamine, dodecenylamine, palmitoylamine, oleylamine, linoleylamine, di-isoamylamine, di-octylamine, di-(2-ethylhexyl) amine, dilaurylamine, cyclohexylamine, 1,2-propylene amine, 1,3-propylenediamine, diethylene triamine, triethylene tetraamine, ethanolamine, triethanolamine, trioctylamine, pyridine, morpholine, 2-methylpiperazine, 1,2-bis(N-piperazinyl-ethane), 1,2-diamine, tetraminooctadecene, triaminooctadecene, N-hexylaniline and the like. They may also be triazole or triazole derivatives, which are described elsewhere as a necessary ingredient in the composition according to the present disclosure.

An example of suitable amines to serve as rust inhibitors are the oil-soluble aliphatic amines in which the aliphatic group is a tertiary alkyl group. Primene™ 81R (a primary aliphatic amine in which the amino nitrogen atom is linked to a tertiary carbon with $C_{12-14}$ highly branched alkyl groups) and Primene™ JMT (a primary aliphatic amine in which the amino nitrogen atom is linked to a tertiary carbon with $C_{16-22}$ highly branched alkyl groups) amines are commercially available amines that fall into this category.

The amines are preferably used in the form of salts with acid phosphates, which are effective as antirust and antiwear agents. The salts of the phosphates and amines may for instance be formed prior to addition to the additive package or they may be formed in situ after the acid phosphate and amine is added to the package.

The amine derivatives of the mono- or dialkyl acid phosphate provide valuable antiwear functionality and should be chosen to be soluble in the selected base oil of the grease. The amines may be of the types described above with preference given to the tertiary amines such as e.g. Primene™ 81-R; (Primene™ JM-T) or Primene™ TOA (a primary aliphatic amine in which the amino nitrogen atom is linked to a tertiary carbon with $C_8$ alkyl groups).

Preferred mono- and/or dialkyl-acid phosphate antiwear additives include at least one acid phosphate moiety derived from a phosphoric acid represented by the formula $R_1O(R_2O)P(O)OH$, where $R_1$ is hydrogen or hydrocarbyl and $R_2$ is hydrocarbyl. $R_1$ and $R_2$ may be the same or different, typically from 10 to 20 carbon atoms and preferably 10 to 12 carbon atoms.

The preferred hydrocarbyl groups for $R_1$ (if present) and $R_2$ are independently selected from $C_1$-$C_{30}$ hydrocarbyls, preferably $C_3$-$C_{20}$ alkyl, alkenyl, or aryl-containing hydrocarbyls, which may be straight chain, branched or cyclic, and may also contain heteroatoms such as O, S, or N. Suitable hydrocarbyl groups are alkyls of 1-40 carbon atoms, preferably 2-20 carbon atoms, more preferably 3-20 carbon atoms, alkenyls of 1-20 carbon atoms, cycloalkyls of 5-20 carbon atoms, aryls of 6-12 carbon atoms, alkaryls of 7-20 carbon atoms or aralkyls of 7-20 carbon atoms. Examples of suitable alkyl groups are methyl, ethyl, propyl, butyl, pentyl, hexyl, heptyl, octyl, nonyl, decyl, methyl-decyl or dimethyl-decyl. Examples of suitable alkenyl groups are ethenyl, propenyl, butenyl, pentenyl or hexenyl. Examples of suitable cycloalkyl groups are cyclohexyl or methylcyclohexyl. Examples of suitable cycloalkenyl groups are 1-, 2-, or 3-cyclohexenyl or 4-methyl-2-cyclohexenyl. Examples of suitable aryl groups are phenyl or diphenyl. Examples of suitable alkaryl groups are 4-methyl-phenyl (p-tolyl) or p-ethyl-phenyl. Examples of suitable aralkyl groups are benzyl or phenethyl. It is possible to use a variety of acid phosphates, for example, one where $R_2$ is an aryl group, and the other where $R_2$ is an alkyl group like hexyl. The hydrocarbyl groups are typically selected from ethyl, iso-propyl, n-butyl, i-amyl, hexyl, 2-ethyl hexyl, n-octyl, nonyl, decyl, dodecyl, tridecyl, tetradecyl, hexadecyl, octadecyl, oleyl, linoleyl, linolenyl, phytol, myricyl, lauryl, myristyl, cetyl, stearyl, amyl phenol, nonyl phenol, methylcyclohexanol, alkylated napthol.

The acid phosphate esters for reaction with the amines may be conveniently formed by reaction of the corresponding alcohols, in the proper stoichiometric amounts, with phosphoric acid, to make the desired mono- or dialkyl phosphate. The preferred acid phosphates are selected from mono- and di-2-ethylhexyl acid phosphate, and mixtures of the two. Further description of useful amine phosphates is in US 2006/0223720 to which reference is made for a description of them.

The imidazolines which are useful as corrosion inhibitors are imidazolines with a long chain ($C_8$-$C_{20}$) alkyl, alkenyl or substituted alkyl or alkenyl substituent on one or both nitrogen atoms. A shorter chain substituent may be on the second nitrogen atom and this may be an alkyl group or substituted alkyl group. Exemplary useful imidazolines include 2-oleyl imidazoline, 1-hydroxyethyl-2-oleyl imidazoline and similar compounds.

Another useful class of corrosion inhibitors are the thiadiazoles, which are especially effective against copper corrosion. Preferably, the thiadiazole comprises at least one of 2,5-dimercapto-1,3,4-thiadiazole; 2-mercapto-5-hydrocarbylthio-1,3,4-thiadiazoles; 2-mercapto-5-hydrocarbyldithio-1,3,4-thiadiazoles; 2,5-bis(hydrocarbylthio)- and 2,5-bis(hydrocarbyldithio)-1,3,4-thiadiazoles. The more preferred compounds are the 1,3,4-thiadiazoles, especially the 2-hydrocarbyldithio-5-mercapto-1,3,4-dithiadiazoles and the 2,5-bis(hydrocaroyldithio)-1,3,4-thiadiazoles, a number of which are available commercially from Afton Corporation as Hitec® 4313 or from Lubrizol Corporation as Lubrizol® 5955A.

Copper passivators include thiazoles, triazoles, and thiadizoles such as 2-mercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis-(hydrocarbylthio)-1,3,4-thiadiazoles, and 2,5-bis-(hydrocarbyldithio)-1,3,4-thiadiazoles. The imidazolines described above may also be suitable for providing copper passivation functionality.

Anti-wear and/or extreme pressure agents can be incorporated, typically in an amount from 0.1 to 5 wt %, more usually 0.5 to 2 wt %. Examples of anti-wear/extreme pressure agents include metal-free sulfur-containing species including sulfurized olefins, dialkyl polysulfides, diarylpolysulfides, sulfurized fats and oils, sulfurized fatty acid esters, phosphosulfur compounds, trithiones, sulfurized oligomers of $C_2$-$C_8$ monoolefins, sulfurized terpenes, thiocarbamate compounds e.g. metal or ash-free dithiocarbamates such as methylene bis(dibutyldithiocarbamate) or zinc dipentyldithiocarbamate; thiocarbonate compounds, sulfoxides, thiol sulfinates. Other examples include aryl phosphates and phosphites, thiophosphoric acid compounds e.g. zinc dialkyldithiophosphates metal-free phosphorus-containing additives such as esters of phosphorus acids, amine salts of phosphorus acids and phosphorus acid-esters, and partial and total thio analogs of these, for example, acid phosphate anti-wear agents, of the formula $R_1O(R_2O)P(O)OH$, where $R_1$ is hydrogen or hydrocarbyl and $R_2$ is hydrocarbyl.

Additive functionality may optionally be provided by multifunctional additives: antiwear agents, for example, will often provide EP activity; zinc diamyldithiocarbamate, for example, may be used as an oxidation inhibitor and metal deactivator with copper corrosion inhibition. Commercially available blends such as zinc dipentyldithiocarbamate with sulfurized isobutylenes may provide effective EP/antioxidant activity and the blend of methylene bis(dibutyldithiocarbamate) with tolutriazole derivative, is an ashless antioxidant which also exhibits extreme pressure performance alone or in combination with other additives.

Further examples of antiwear/EP agents and other additives are found in US 2007/0289897, to which reference is made for descriptions of them and exemplary methods for their preparation.

Viscosity modifiers (also known as viscosity index improvers (VI improvers), and viscosity improvers) can be included in the grease compositions of this disclosure. Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A–B wherein A is a polymeric block derived predominantly from vinyl aromatic hydrocarbon monomer, and B is a polymeric block derived predominantly from conjugated diene monomer.

Although their presence is not required to obtain the benefit of this disclosure, viscosity modifiers may be used in an amount of less than about 10 weight percent, preferably less than about 7 weight percent, more preferably less than about 4 weight percent, and in certain instances, may be used at less than 2 weight percent, preferably less than about 1 weight percent, and more preferably less than about 0.5 weight percent, based on the total weight of the lubricating oil composition. Viscosity modifiers are typically added as concentrates, in large amounts of diluent oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

ADDITIONAL EMBODIMENTS AND PCT/EP CLAUSES

Embodiment 1

A grease composition comprising: 40 wt % or more of a naphthenic lubricant base stock comprising 60 wt % or more of naphthenes relative to a weight of the naphthenic lubricant base stock, a viscosity index of 120 or less, and a kinematic viscosity at 100° C. of 15 cSt or less; 30 wt % or more of a second lubricant base stock comprising a kinematic viscosity at 100° C. of 16 cSt or more; and one or more grease performance additives.

Embodiment 2

The grease composition of Embodiment 1, wherein the naphthenic lubricant base stock comprises 20 wt % or less of aromatics relative to a weight of the naphthenic lubricant base stock, or 15 wt % or less, or 10 wt % or less.

Embodiment 3

The grease composition of any of the above embodiments, wherein the naphthenic lubricant base stock comprises 20 wt % or less of paraffins relative to a weight of the naphthenic lubricant base stock, or 15 wt % or less, or 10 wt % or less.

Embodiment 4

The grease composition of any of the above embodiments, wherein the naphthenic lubricant base stock comprises 65 wt % or more of naphthenes, or 70 wt % or more.

Embodiment 5

The grease composition of any of the above embodiments, wherein the naphthenic lubricant base stock comprises a viscosity index of 118 or less, or 115 or less, or 110 or less.

Embodiment 6

The grease composition of any of the above embodiments, wherein the naphthenic lubricant base stock comprises a pour point of −20° C. or more, or −15° C. or more, or −10° C. or more.

Embodiment 7

The grease composition of any of the above embodiments, wherein the second lubricant base stock comprises a viscosity index of 80 to 120, or 85 to 105.

Embodiment 8

The grease composition of any of the above embodiments, wherein the second lubricant base stock comprises a kinematic viscosity at 100° C. of 24 cSt or more, or 30 cSt or more.

Embodiment 9

The grease composition of any of the above embodiments, wherein the one or more additives comprise a viscosity modifier additive.

Embodiment 10

The grease composition of any of the above embodiments, wherein the grease composition comprises 45 wt % or more of the naphthenic lubricant base stock, or 50 wt % or more.

Embodiment 11

The grease composition of any of the above embodiments, wherein the grease composition comprises 35 wt % or more of the second lubricant base stock, or 40 wt % or more.

Embodiment 12

The grease composition of any of the above embodiments, wherein the naphthenic lubricant base stock comprises a sulfur content of 500 wppm or less relative to a weight of the naphthenic lubricant base stock, or 300 wppm or less, or 100 wppm or less.

Embodiment 13

The grease composition of any of the above embodiments, wherein the grease composition comprises a flow pressure of 100 kPa-a or less under a flow pressure test according to DIN 51805 MOD at −20° C.

Embodiment 14

The grease composition of any of the above embodiments, wherein the grease composition comprises a starting torque of 19.0 N-m or less under a test according to ASTM D4693 at −40° C., or a torque at 60 seconds of 12.0 N-m or less under a test according to ASTM D4693 at −40° C., or a combination thereof.

Embodiment 15

The grease composition of any of the above embodiments, wherein the one or more grease performance additives comprise one or more additives selected from the groups consisting of an antiwear additive, an antioxidant, a detergent, a dispersant, a pour point depressant, a corrosion inhibitor, a metal deactivator, a seal compatibility additive, a demulsifying agent, an anti-foam agent, inhibitor, an anti-rust additive, and combinations thereof.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A grease composition comprising:

40 wt % or more of a Group II lubricant base stock comprising 60 wt % or more of naphthenes relative to a weight of the Group II lubricant base stock, about 43.8 wt % a combination of 2-ring naphthenes and aromatics relative to the weight of the Group II lubricant base stock, a viscosity index of 120 or less, and a kinematic viscosity at 100° C. of 15 cSt or less;

30 wt % or more of a second lubricant base stock comprising a kinematic viscosity at 100° C. of 16 cSt or more; and one or more grease performance additives.

2. The grease composition of claim 1, wherein the Group II lubricant base stock comprises 20 wt % or less of aromatics relative to a weight of the Group II lubricant base stock.

3. The grease composition of claim 1, wherein the Group II lubricant base stock comprises 20 wt % or less of paraffins relative to a weight of the Group II lubricant base stock.

4. The grease composition of claim 1, wherein the Group II lubricant base stock comprises 65 wt % or more of naphthenes.

5. The grease composition of claim 1, wherein the Group II lubricant base stock comprises a viscosity index of 118 or less.

6. The grease composition of claim 1, wherein the Group II lubricant base stock comprises a pour point of −12° C. or higher.

7. The grease composition of claim 1, wherein the second lubricant base stock comprises a viscosity index of 80 to 120.

8. The grease composition of claim 1, wherein the second lubricant base stock comprises a kinematic viscosity at 100° C. of 24 cSt or more.

9. The grease composition of claim 1, wherein the one or more additives comprise a viscosity modifier additive.

10. The grease composition of claim 1, wherein the grease composition comprises 45 wt % or more of the Group II lubricant base stock.

11. The grease composition of claim 1, wherein the grease composition comprises 35 wt % or more of the second lubricant base stock.

12. The grease composition of claim 1, wherein the Group II lubricant base stock comprises a sulfur content of 500 wppm or less relative to a weight of the Group II lubricant base stock.

13. The grease composition of claim 1, wherein the grease composition comprises a flow pressure of 100 kPa-a or less under a flow pressure test according to DIN 51805 MOD at −20° C.

14. The grease composition of claim 1, wherein the grease composition comprises a starting torque of 19.0 N-m or less under a test according to ASTM D4693 at −40° C., or a torque at 60 seconds of 12.0 N-m or less under a test according to ASTM D4693 at −40° C., or a combination thereof.

15. The grease composition of claim 1, wherein the one or more grease performance additives comprise one or more additives selected from the group consisting of an antiwear additive, an antioxidant, a detergent, a dispersant, a pour point depressant, a corrosion inhibitor, a metal deactivator, a seal compatibility additive, a demulsifying agent, an anti-foam agent, inhibitor, an anti-rust additive, and combinations thereof.

16. A method for improving the low temperature performance of a grease composition used in equipment with moving parts, said method comprising:

providing a grease composition comprising:

i. 40 wt % or more of a Group II lubricant base stock including 60 wt % or more of naphthenes relative to a weight of the Group II lubricant base stock, about 43.8 wt % of a combination of 2-ring naphthenes and aromatics relative to the weight of the Group II lubricant base stock, a viscosity index of 120 or less, and a kinematic viscosity at 100° C. of 15 cSt or less;

ii. 30 wt % or more of a second lubricant base stock comprising a kinematic viscosity at 100° C. of 16 cSt or more; and iii. one or more grease performance additives, and lubricating a piece of equipment with moving parts with said grease composition to improve the low temperature performance of the piece of equipment.

17. The method of claim 16, wherein the Group II lubricant base stock comprises 20 wt % or less of aromatics relative to a weight of the Group II lubricant base stock.

18. The method of claim 16, wherein the Group II lubricant base stock comprises 20 wt % or less of paraffins relative to a weight of the Group II lubricant base stock.

19. The method of claim 16, wherein the Group II lubricant base stock comprises a pour point of −12° C. or higher.

20. The method of claim 16, wherein the grease composition comprises a flow pressure of 100 kPa-a or less under a flow pressure test according to DIN 51805 MOD at −20° C.

21. The method of claim 16, wherein the grease composition comprises a starting torque of 19.0 N-m or less under a test according to ASTM D4693 at −40° C., or a torque at 60 seconds of 12.0 N-m or less under a test according to ASTM D4693 at −40° C., or a combination thereof.

22. The method of claim 16, wherein the one or more grease performance additives comprise one or more additives selected from the group consisting of an antiwear additive, an antioxidant, a detergent, a dispersant, a pour point depressant, a corrosion inhibitor, a metal deactivator, a seal compatibility additive, a demulsifying agent, an anti-foam agent, inhibitor, an anti-rust additive, and combinations thereof.

* * * * *